United States Patent [19]

Mayer

[11] Patent Number: 4,776,858

[45] Date of Patent: Oct. 11, 1988

[54] BAIT COLORING COMPOSITION

[76] Inventor: Roy A. P. Mayer, 597 Clarke Avenue, Ottawa, Ontario, Canada, K1K OY8

[21] Appl. No.: 26,385

[22] Filed: Mar. 16, 1987

Related U.S. Application Data

[63] Continuation-in-part of Ser. No. 939,783, Dec. 9, 1986, abandoned.

[51] Int. Cl.[4] ..... D06P 3/14; D06P 3/24

[52] U.S. Cl. ..... 8/517; 8/594; 8/599; 8/625; 8/680; 8/681; 8/682; 8/685

[58] Field of Search ..... 8/517, 680, 685

[56] References Cited

FOREIGN PATENT DOCUMENTS 664579 6/1963 Canada .

OTHER PUBLICATIONS

"*Colour Index*", (Third Edition), vol. 4, (Soc. Dyers and Coldwrists), 1971, pp. 4068, 4087, 4093, 4132, 4383, 4428 and 4597.

*Primary Examiner*—A. Lionel Clingman

*Attorney, Agent, or Firm*—Murray and Whisenhunt

[57] ABSTRACT

A composition for coloring bait which comprises (a) at least one biologically acceptable and palatable colorant; (b) a mordant for binding said colorant to live bait; (c) a surfactant or an acidulant; and (d) an aqueous carrier. A kit for coloring live bait to catch fish comprising (a), (b) and (c) of the composition also forms part of the invention.

12 Claims, No Drawings

BAIT COLORING COMPOSITION

BACKGROUND TO THE INVENTION

This application is a continuation-in-part of application Ser. No. 939,783 filed on Dec. 9, 1986 now abandoned.

FIELD OF THE INVENTION

This invention concerns means for colouring bait especially live bait, such as minnows, worms, crawfish, frogs, leeches or insects to attract fish to strike at a lure and enable an angler to catch fish.

In addition to using live bait, colored artificial lures are often used to catch fish. Live bait may be used along with a coloured artificial lure. Brightly coloured fish, such as goldfish and other exotic fish, when used as lures can produce dramatic results but cause an undesirable negative environmental side effect in that alien species can be released. The practice is often illegal and certainly should be discouraged.

Sets of artificial lures of different colours have been used in conjunction with a colour-selection meter such as Color-C-Lector*. Such a meter guides the user as to which lure colour to use at what depth in clear, stained or muddy water. The user may have to make allowances for preferences of the fish. Combining colours has also been suggested as well as purchasing all-white artificial lures and using marking pens or paints that match the colour recommended by the reading of the colour selection meter. Artificial lures attempt to simulate the natural attributing attractors of live bait which assist in inducing a fish to strike such as movement and shape, with the addition of attractive colors, and also every sound and scent.

* Trademark

DESCRIPTION OF PRIOR ART

Canadian Pat. No. 664,579 discloses a process for dyeing bait fish eggs while compressed, in the presence of a preservative and bait eggs produced thereby.

There is therefore a need for an improved means for live bait fishing which is biologically and environmentally acceptable and can be used in as many water conditions as possible with a wide range of target fish species. There is also a need for an improved bait for sport and commercial fishing use.

SUMMARY OF THE INVENTION

According to the present invention there is provided a composition for colouring bait which comprises (a) a least one biologically acceptable and palatable colourant; (b) a mordant for binding said colourant to bait; (c) a surfactant or an acidulant; and (d) an aqueous carrier, preferably distilled water.

DESCRIPTION OF THE PREFERRED EMBODIMENTS

In such a composition of the invention, summarized above, the colourant is preferably selected from FD&C Yellow No. 5 FD&C Yellow No. 6, FD&C Red No. 2, FD&C Red No. 3, FD&C Red No. 4, FD&C Red No. 40, FD&C Green No. 3, FD&C Blue No. 1 and FD&C Blue No. 2.

The mordant is preferably a suitable water-soluble aluminum, calcium or barium salt such as aluminum sulphate, aluminum chloride, aluminum nitrate, calcium chloride, calcium sulphate, calcium nitrate, barium chloride and barium nitrate.

The surfactant, which should of course be biologically acceptable, preferably comprises up to about 3% by weight of the composition, particularly preferably about 1% by weight of the composition. We have found an alkoxylate surfactant, especially a nonylphenyl alkoxylate, such as that sold under the trade name NP-9 by Alkaril of Mississauga, Ontario to be particularly useful.

The acidulant is preferably selected from sulphuric acid, hydrochloric acid, citric acid, acetic acid, fumaric acid, malic acid or oxalic acid and preferably should be present in an amount sufficient to give a pH of less than 5.0, even more preferably a pH of less than 3.5. but should not be so strong as to be dangerous to the user or to repel fish when used in the bait.

The above-mentioned compositions are preferably used in combination with (e) a biologically acceptable suspending agent for improving stability and homogeneity of a solution of said composition. Preferably the suspending agent is selected from a vegetable gum, a derivatized starch polymer, a derivatized cellulose, a dextran, a fumed silica and a polyvinyl pyrrolidone. Aragum 2000* and xanthan gum are especially useful.

* Trademark

Preferably the colourant, mordant, such as aluminum sulphate, and the acidulant such as citric acid each separately comprise about 10% by weight of the composition, the surfactant comprises about 1% by weight of the composition and, when present, the suspending agent, such as Aragum 2000 or xanthan gum, comprises about 4% by weight of the composition.

According to another aspect of the invention there is provided a multi-component kit for colouring bait which kit comprises in separate containers components (a) at least one biologically acceptable and palatable colourant; (b) a mordant for binding said colourant to bait; and (c) a surfactant or an acidulant to make acidic an aqueous composition of the components of said kit.

A preferred kit comprises (a) at least one biologically acceptable and palatable colourant selected from FD&C Yellow No. 5, FD&C Yellow No. 6, FD&C Red No. 2, FD&C Red No. 3, FD&C Red No. 4, FD&C Red No. 40, FD&C Green No. 3, FD&C Blue No. 1 and FD&C Blue No. 2;

(b) a mordant for binding said colourant to bait selected from aluminum sulphate, aluminum chloride, aluminum nitrate, calcium chloride, calcium sulphate, calcium nitrate, barium chloride and barium nitrate; and (c) a surfactant or an acidulant to make the pH of the composition less than 5.0 selected from sulphuric acid, hydrochloric acid, citric acid, acetic acid, fumaric acid and malic acid.

Preferably the kit of the invention should also contain a biologically acceptable suspending agent for improving stability and homogeneity of an aqueous composition of the components of the kit. Such a suspending agent may be selected from a vegetable gum, a derivatized starch polymer, a derivatized cellulose, a dextran, a fumed silica and a polyvinyl pyrrolidone. Especially preferred suspending agents include Aragum 2000 and xanthan gum.

The preferred food dyes which are used as colourants have an affinity for proteins, particularly for collagen, the main component of fish scales. When applied to live minnows, however the food dyes were not effective in staining the minnows. We found that if the dyes are dissolved in a moderately acidic solution that they were then able to effectively stain the minnows' scales. It appears that the food dyes alone were ineffective because of a mucopolysaccharide slime layer that encoats the live minnow. Inorganic mineral acids (e.g. hydrochloric or sulphuric acid) or organic acids (e.g. citric or acetic acid) are suitable acidulants.

The staining ability of the colourants is enhanced by using a mordant. A mordant, in the context of this invention, is a substance which facilitates binding of the colourant to the bait. The preferred food dyes are soluble because of the presence of sulphonic acid groups in their molecular structure. They are also sodium salts. Conversion of the sodium salt to the salt of another selected metal reduces dye solubility and enhances deposition onto an insoluble substrate (in this case, the bait). Mordants of soluble aluminum, calcium or barium are particularly suitable. It should be noted that salts of aluminum have a dual functionality in the context of this invention, especially with respect to colouring minnows in that their solutions are acidic (e.g. a pH of 3.0 for a 10% solution of aluminum sulphate). This means that as well as supplying aluminum ions for insoluble salt formation they also provide the acidity required to penetrate the mucopolysaccharide slime layer.

The surfactant is especially useful when intending to use these coloured baits in cold waters. It enhances adherence of the colourants to the bait.

Colouring bait can be enhanced with the optional use of a suitable suspending agent. The agent should be biologically acceptable. The suspending agents improve the stability and homogeneity of the compositions. In addition they also modify the viscosity and surface tension of the compositions, thus improving the clinging of the composition to the bait.

Table 1 is a comparison chart using the colour composition on minnows and comparing the catches with those made with plain minnows. In general, two people fished from different sides of the same boat exchanging positions and bait type at intervals in an effort to remove any effect of the individual fisher or of the position with respect to the boat.

The colour composition can be applied to the bait in a variety of ways, e.g. by dipping the bait in a bath of the composition, by brushing the composition onto the bait, by applying drops by means of a pipette or by squirting the composition from a squeeze bottle. It is possible to apply the colour composition from an aerosol container, but this is expensive and therefore not preferred. The bait can be coloured by wiping it with or squeezing it in a sponge or absorbent pad saturated with the colour composition.

TABLE 1

| | Comparison Chart Number of bites, including catches | |
|---|---|---|
| | Using Color Composition | Using Plain Minnows |
| Day 15 | 23 Perch | 11 Perch |
| | 2 Small Mouth Bass | 0 |
| | 4 Rock Bass | 0 |
| Day 14 | 5 Lake Trout | 1 Lake Trout |
| Day 13 | 3 Lake Trout | 0 |
| Day 12 | 2 Small Mouth Bass | 0 |
| Day 11 | 2 Small Mouth Bass | 1 Small Mouth Bass |
| | 1 Large Mouth Bass | |
| Day 10 | 4 Lake Trout | 2 Lake Trout |
| Day 9 | 7 Perch | 2 Perch |
| | 2 Small Mouth Bass | 0 |
| | 2 Catfish | 0 |
| Day 8 | 6 Lake Trout | 1 Lake Trout |

TABLE 1-continued

| | Comparison Chart Number of bites, including catches | |
|---|---|---|
| | Using Color Composition | Using Plain Minnows |
| Day 7 | 2 Lake Trout | 1 Lake Trout |
| | 1 Small Mouth Bass | 0 |
| Day 6 | 4 Lake Trout | 2 Lake Trout |
| Day 5 | 6 Small Mouth Bass | 1 Small Mouth Bass |
| Day 4 | 14 Perch | 6 Perch |
| Day 3 | 2 Lake Trout | 1 Lake Trout |
| Day 2 | 6 Lake Trout | 2 Lake Trout |
| Day 1 | 6 Lake Trout | 2 Lake Trout |

What I claim as my invention is:

1. A composition for coloring fish bait, said composition comprising:

(a) about 10% by weight of at least one acid dye;

(b) a substance capable of binding said dye to fish bait selected from the group consisting of aluminum sulphate, aluminum chloride, aluminum nitrate, calcium chloride, calcium nitrate, barium chloride and barium nitrate;

(c) about 1 to 3% by weight of the composition of a surface active agent; and (d) water;

said composition being ecologically acceptable when applied to fish bait and non-toxic to live fish bait when applied to live fish bait, said composition, after application to fish bait, being palatable to fish species sought.

2. The composition of claim 1, wherein said dye is selected from the group consisting of FD&C Yellow No. 5, FD&C Yellow No. 6, FD&C Red No. 2, FD&C Red No. 3, FD&C Red No. 4, FD&C Red No. 40, FD&C Green No. 3, FD&C Blue No. 1 and FD&C Blue No. 2.

3. The composition according to claim 1, and further including an acid selected from the group consisting of citric acid, acetic acid, fumaric acid, malic acid and oxalic acid.

4. The composition according to claim 3 wherein the pH is less than 5.0.

5. The composition according to claim 3 wherein said acid comprises about 10% by weight of the composition.

6. The composition of claim 3 wherein said acid is citric acid and comprises about 10% by weight of the composition.

7. The composition of claim 1 wherein said substance (b) is aluminum sulphate and comprises about 10% by weight of the composition.

8. A composition for coloring fish bait, said composition comprising:

(a) about 10% by weight of at least one dye selected from the group consisting of FD&C Yellow No. 5, FD&C Yellow No. 6, FD&C Red No. 2, FD&C Red No. 3, FD&C Red No. 4, FD&C Red No. 40, FD&C Green No. 3, FD&C Blue No. 1 and FD&C Blue No. 2;

(b) a substance capable of binding said dye to fish bait selected from the group consisting of aluminum sulphate, aluminum choride, aluminum nitrate, calcium chloride, calcium nitrate, barium chloride and barium nitrate;

(c) about 1–3% by weight of the composition of a surface active agent; and (d) water;

said composition being ecologically acceptable when applied to fish bait and non-toxic to live fish bait when applied to live fish bait, said composition, after application to fish bait, being palatable to fish species sought.

9. The composition of claim 1 wherein component (c) is present in an amount of about 1% by weight of the composition.

10. The composition of claim 1 wherein said substance (b) is aluminum sulphate and comprises about 10% by weight of the composition and component (c) is a surface active agent comprising about 1% by weight of the composition.

11. The composition of claim 1 wherein said surface active agent is an alkoxylate surfactant.

12. The composition of claim 11 wherein said alkoxylate surfactant is nonylphenyl alkoxylate.

* * * * *